US005898236A

United States Patent [19]

Reed et al.

[11] Patent Number: 5,898,236

[45] Date of Patent: Apr. 27, 1999

[54] MAGNETIC SWITCH COUPLING TO SYNCHRONIZE MAGNETIC MODULATORS

[75] Inventors: Kim W. Reed; Paul Kiekel, both of Albuquerque, N.M.

[73] Assignee: Sandia Corporation, Albuquerque, N.M.

[21] Appl. No.: 08/881,580

[22] Filed: Jun. 24, 1997

[51] Int. Cl.[6] ..... H01F 27/42

[52] U.S. Cl. ..... 307/104; 335/11

[58] Field of Search ..... 307/104, 106, 307/108, 109, 110; 336/69, 73, 188; 320/166, 167, DIG. 23, DIG. 24; 335/2, 11, 28, 59, 63; 333/20

[56] References Cited

U.S. PATENT DOCUMENTS

| | | | |
|---|---|---|---|
| 3,831,078 | 8/1974 | Peil | 321/2 |
| 4,437,026 | 3/1984 | Demirjian et al. | 310/11 |
| 4,549,091 | 10/1985 | Fahlen et al. | 307/106 |
| 4,589,123 | 5/1986 | Pearlman et al. | 315/111.17 |
| 4,849,649 | 7/1989 | Roche et al. | 307/108 |
| 4,928,020 | 5/1990 | Birx et al. | 307/106 |
| 4,996,494 | 2/1991 | Ranon | 307/106 |
| 5,105,097 | 4/1992 | Rothe | 307/108 |
| 5,138,193 | 8/1992 | Bruno et al. | 307/106 |
| 5,313,481 | 5/1994 | Cook et al. | 372/37 |
| 5,315,611 | 5/1994 | Ball et al. | 327/56 |
| 5,479,087 | 12/1995 | Wright | 323/267 |
| 5,623,171 | 4/1997 | Nakajima | 307/106 |
| 5,665,966 | 9/1997 | Dahl et al. | 250/281 |
| 5,682,304 | 10/1997 | Shteynberg | 363/75 |

*Primary Examiner*—Richard T. Elms
*Attorney, Agent, or Firm*—Gregory A. Cone

[57] ABSTRACT

Apparatus for synchronizing the output pulses from a pair of magnetic switches. An electrically conductive loop is provided between the pair of switches with the loop having windlings about the core of each of the magnetic switches. The magnetic coupling created by the loop removes voltage and timing variations between the outputs of the two magnetic switches caused by any of a variety of factors. The only remaining variation is a very small fixed timing offset caused by the geometry and length of the loop itself.

8 Claims, 8 Drawing Sheets

MAGNETIC SWITCH COUPLING TO SYNCHRONIZE MAGNETIC MODULATORS

CROSS-REFERENCE TO RELATED APPLICATIONS

None.

STATEMENT REGARDING FEDERALLY SPONSORED RESEARCH OR DEVELOPMENT

This invention was made with Government support under Contract DE-AC04-94AL85000 awarded by the U.S. Department of Energy. The Government has certain rights in the invention.

BACKGROUND OF THE INVENTION

This invention relates to magnetic switches. More particularly, this invention relates to an apparatus for causing multiple magnetic switches to switch in a synchronized manner.

Numerous magnetic modulator applications including particle beam accelerators, high power linear induction voltage adders and laser drivers require the timing of the output pulses be synchronized both to the trigger pulse and between multiple machines. The timing drift on the output of a magnetic modulator can be separated into two categories. Slow changes such as core heating and prime power supply drift cause slow steady timing drifts that can be easily compensated by monitoring the output timing and slowly adjusting the trigger timing to compensate. Random shot to shot variations due to main power supply ripple, primary switch jitter and reflections that effect the bias state of the switches from shot to shot and therefore the timing, require a compensation mechanism that is fast enough to act between shots.

Techniques have been developed to compensate for both of these types of time shifts. The most generalized of these utilize a combination of precision charge voltage control and trigger timing compensation based on measurement of the charge voltage and bias currents just before a shot. While this type of jitter control has been used with great success, it involves the complexity of both microprocessors and analog circuitry in the feedback loop, and it requires calibrations to be established and maintained that correlate the required timing offsets to the measured bias and charge voltage offsets.

BRIEF SUMMARY OF THE INVENTION

Magnetic coupling offers a simple, passive maintenance-free method to synchronize the outputs of two or more magnetic modulators that avoids the complexity of computerized and electronic feedback schemes. When two magnetic switches are properly coupled together, they are forced to switch at the same time to within the fixed delay in the coupling connections that is determined by the geometry. Thus, magnetic coupling compensates for timing variations at the outputs of the coupled modulators caused by slow parameter and charge voltage drifts as well as fast random variations due to power supply ripple, primary switch jitter and reflections. Magnetic coupling provides the additional benefit of helping to equalize the charge voltages at corresponding stages of the coupled modulators.

BRIEF DESCRIPTION OF THE SEVERAL VIEWS OF THE DRAWING

In FIG. 6A the voltage on COA is 320 volts below the voltage on COB (corresponding to a 9 kV difference on the switches) and in FIG. 6B the prime switch at the input of machine A is closed 1000 ns before the prime switch at the input of machine B. The 70 ns offset in the output waveforms is due to the fixed propagation delay in the coupling connections.

DETAILED DESCRIPTION OF THE INVENTION

Figure 1:
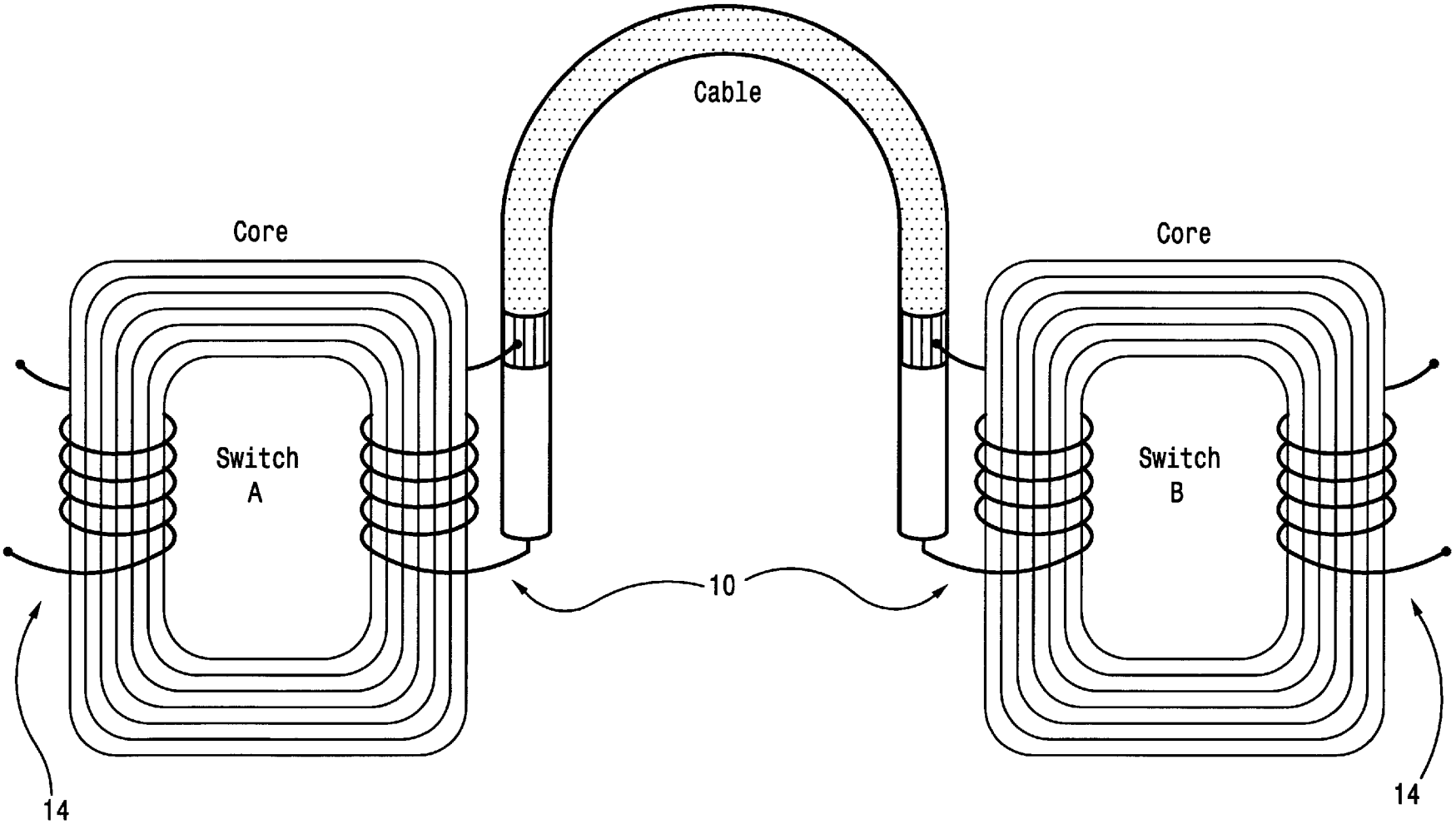
FIG. 1 is a schematic view of the apparatus of the invention as employed for a single pair of magnetic switches.

The magnetic coupling scheme is shown in FIG. 1, in which equal coupling windings 10 are put on the switches (switch A and switch B) to be coupled and then interconnected symmetrically so that no current flows in the coupling windings 10 if the currents in the main electrical windings 14 of switch A have the same input-to-output sense as the currents in the main electrical windings 14 of switch B. The main electrical windings 14 are those connected to the energy storage capacitors in the magnetic modulator circuit. A positive input-to-output sense is taken as flowing from the capacitor that is on the side of the magnetic switch that is nearest electrically to the input end of the magnetic modulator through the main magnetic switch windings to the capacitor that is nearest electrically to the load end of the magnetic modulator. In practice, the same input-to-output sense will occur in the main windings of switch MS1A and switch MS1B if the capacitors C1A and C1B preceding the switches, MS1A and MS1B respectively, charge together and if the capacitors C2A and C2B are both initially discharged. Similarly, the same input-to-output sense will occur in the main windings of switch MS2A and switch MS2B if the capacitors C2A and C2B preceding the switches, MS2A and MS2B respectively, charge together and if the capacitors C3A and C3B are both initially discharged. With corresponding magnetic switches magnetically coupled in this fashion, if the capacitor on the input side of one switch (input being closest electrically to the input of the magnetic modulator) starts to charge before the capacitor on the input side of the corresponding switch in the other modulator, then the transformer action of the coupling winding 10 will cause the capacitor on the input side of the other switch to begin to charge as well. If manufacturing differences, temperature differences, bias differences, charge voltage differences, charge time differences, trigger timing differences, reflections, or and other circuit parameters cause one magnetic switch to start to transition from the high inductance state to the low inductance state (to close) before the other, the coupling winding 10 acts as a shorted secondary on the slow switch and forces it into a low inductance or switched (closed) state.

The two magnetic coupling windings on the coupled magnetic switches must be connected in such a relative polarity so that no current is induced in the coupling winding by simultaneous equal currents flowing in the main windings from the input toward the output of both magnetically coupled magnetic switches. The main electrical windings are those connected to the energy storage capacitors in the magnetic modulator circuit. A positive input-to-output sense is taken as flowing from the capacitor that is on the side of the magnetic switch that is nearest electrically to the input end of the magnetic modulator through the main magnetic switch windings to the capacitor that is nearest electrically to the load end of the magnetic modulator.

Figure 2:
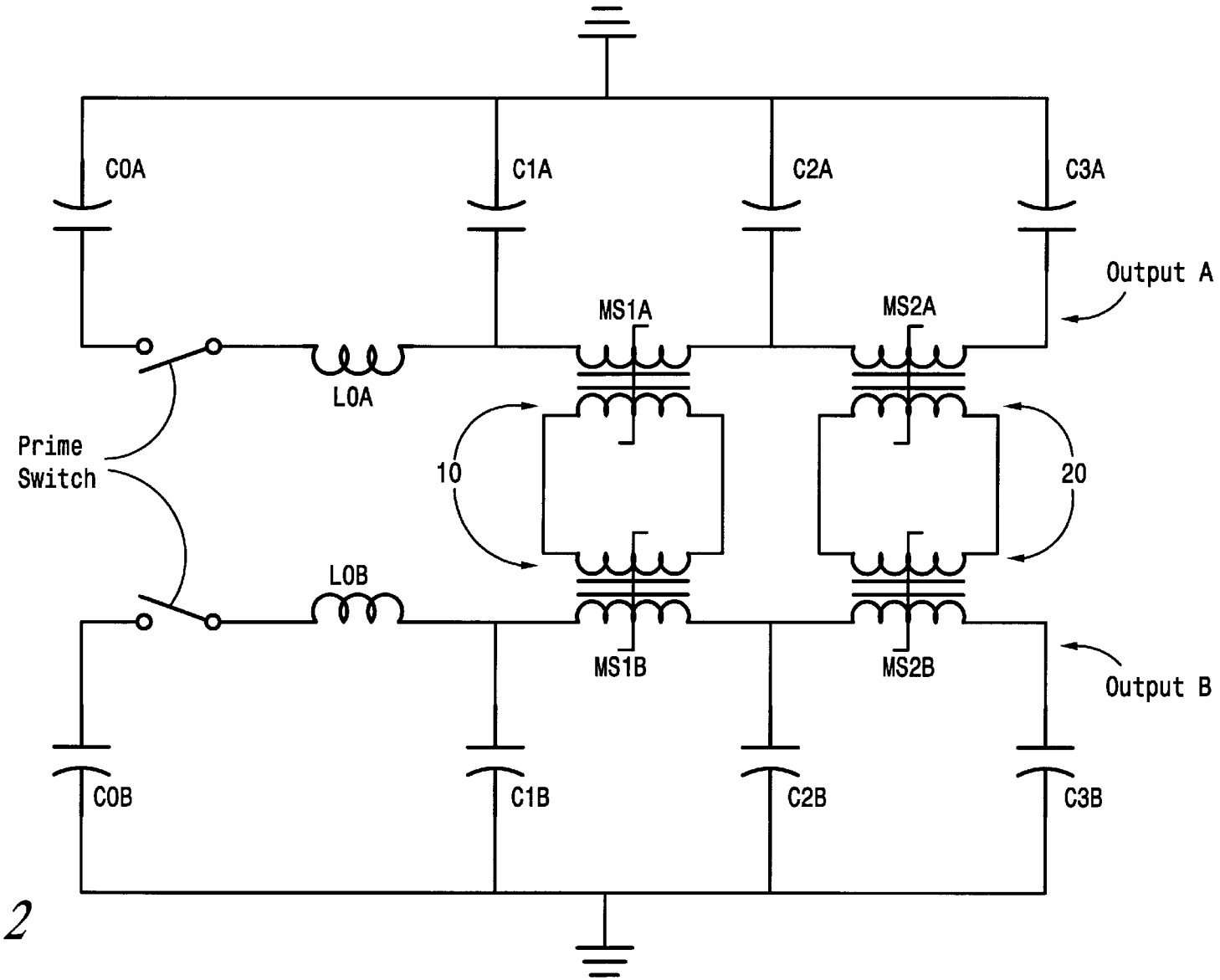
FIG. 2 is an electrical schematic drawing of a two stage Melville magnetic modulator pair with magnetic coupling.
Figure 3A:
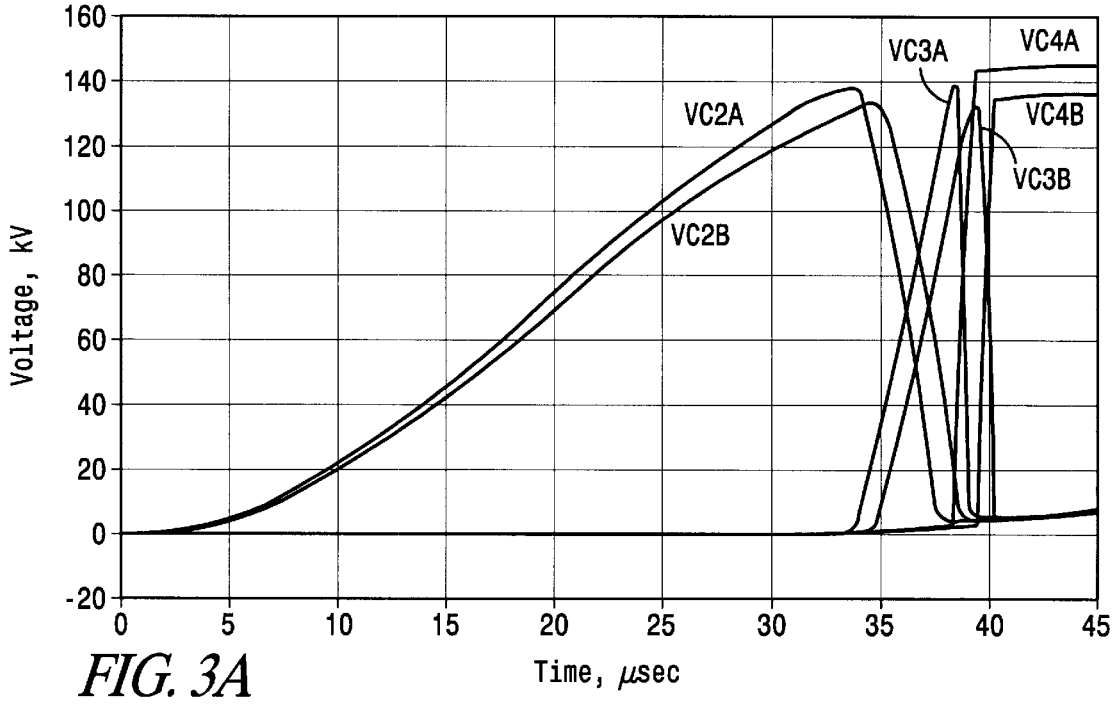
FIGS. 3A and 3B are graphs showing capacitor voltages for the apparatus of FIG. 2 with an initial charge on the input of the A modulator of 150 kV and on the input of the B modulator of 140 kV, with and without the magnetic coupling respectively. These graphs (and FIGS. 4A, 4B, 5A and 5B)) are computer-generated simulations.
Figure 3B:
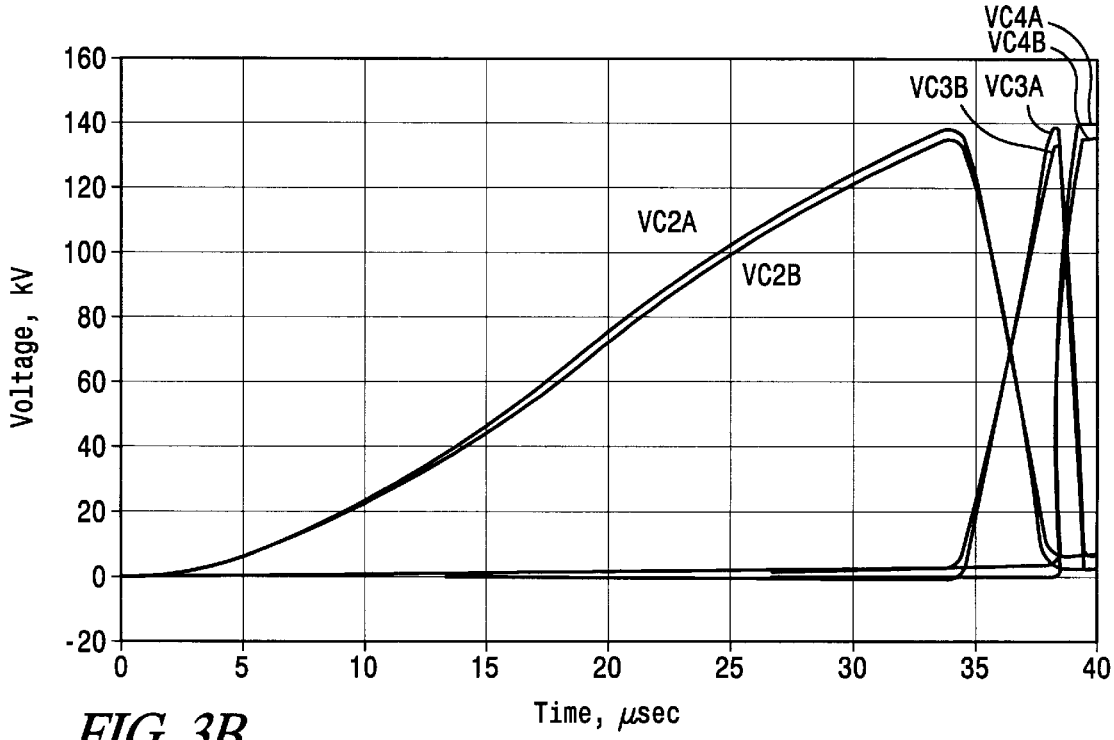

A typical pair of Melville magnetic modulators is shown in FIG. 2 with magnetic couplings 10 and 20 added between the corresponding magnetic switches MS1A, MS1B and between MS2A, MS2B respectively. The effect on switch timing caused by different charge voltages on the two modulators is shown in the computer simulation of FIG. 3. Although this detailed description portrays the magnetic coupling between the various stages of a separate pair of magnetic modulators, the invention can be extended to provide magnetic coupling between three or more parallel magnetic modulators.

Figure 4A:
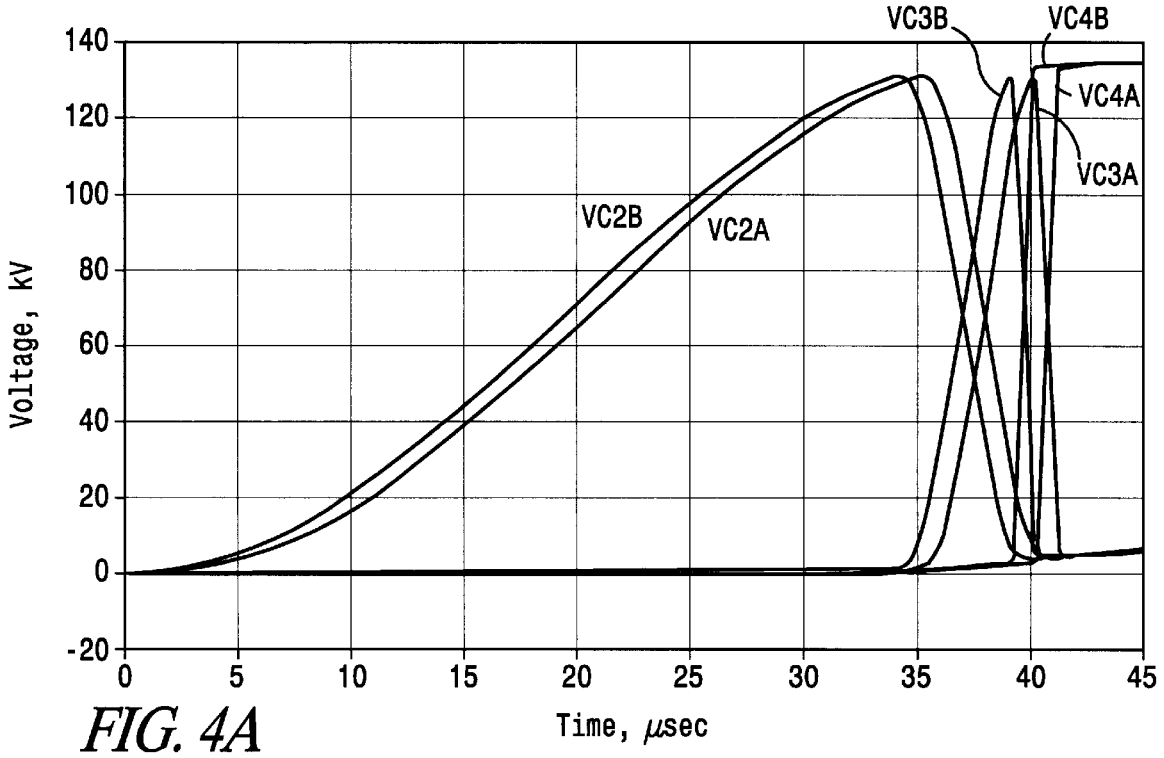
FIGS. 4A and 4B are similar to the graphs of FIGS. 3A and 3B but FIG. 4A showing the case where the primary switch at the input end of modulator A is closed 1 $\mu$s after the primary switch at the input end of modulator B without magnetic coupling and FIG. 4B with magnetic coupling.
Figure 4B:
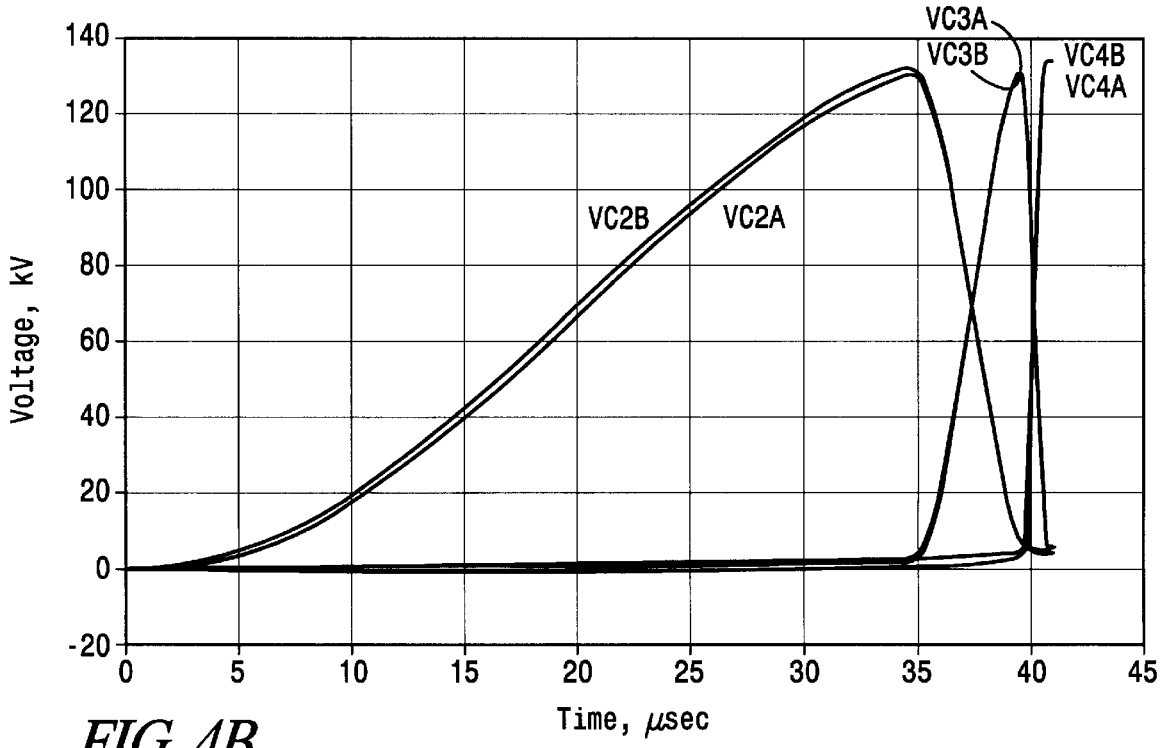

In FIG. 3, the voltages on the capacitors in the two modulators are displayed so that the voltages on corresponding capacitors in the two machines can be compared. The time at which a given magnetic switch closes is marked by the inflection in the voltage on the capacitor that precedes the magnetic switch from an upward derivative to a downward derivative The A modulator has an initial charge of 150 kV on COA and the B modulator has an initial charge of 140 kV on COB. The results of a PSPICE simulation of this modulator pair without and with coupling are shown in FIGS. 3 (*a*) and (*b*), respectively. Without coupling, FIG. 3(*a*), the different charge voltages cause the corresponding switches to switch at different times, and most importantly the charge waveforms on the last capacitor do not occur at the same time. This asynchronism would prevent these output waveforms or waveforms derived from them from being combined in a linear induction voltage adder or particle accelerator. With magnetic coupling, however, FIG. 3(*b*), all of the magnetic switches switch at the same time, and most importantly the voltage waveforms on the output capacitors rise at the same time allowing them or waveforms derived from them to be efficiently combined in a linear induction voltage adder or particle accelerator. Also note that the magnetic coupling tends to pull the amplitudes of the capacitor charging waveforms at the peak closer together. The effect on switch timing of triggering the A-modulator 1 $\mu$s after the B-modulator is shown in FIGS. 4A and 4B. As would be expected, without magnetic coupling, FIG. 4(*a*), each of the A-modulator switches switch 1 $\mu$s after their corresponding B-modulator counterparts. With magnetic coupling, however, FIG. 4(*b*), the A-modulator switches switch at the same time as the B-modulator counterparts.

Figure 5A:
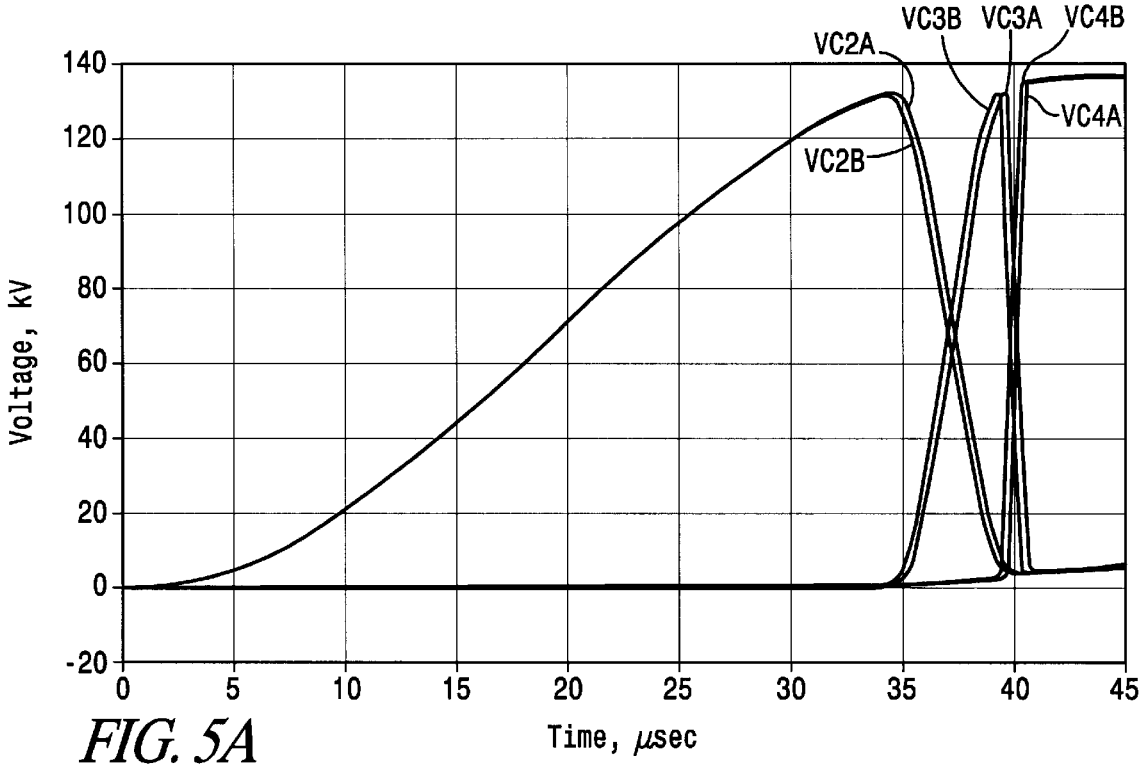
FIGS. 5A and 5B are similar but demonstrate the effect for modulator A switches having 2% more packing factor than modulator B switches, without and with magnetic coupling respectively. Packing factor is the ratio of the volume of the magnetic material in the switch to the volume enclosed by the windings of the switch.
Figure 5B:
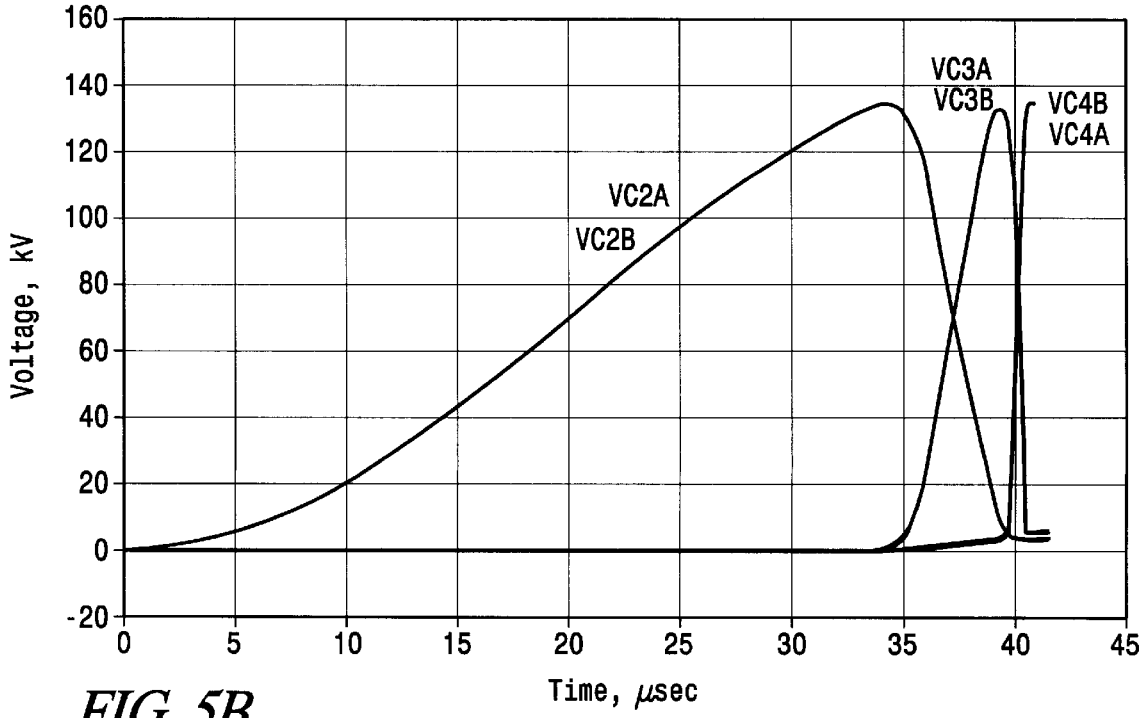

Differences in the corresponding switch parameters, such as magnetic core packing factor, FIGS. 5A and 5B, is another cause for differences in the switching times in the two modulators. Without magnetic coupling, FIG. 5(*a*), a 2% difference in the packing factors in the magnetic cores of corresponding switches in the two modulators causes a significant difference in the switching times. With magnetic coupling between corresponding magnetic switches in the A and B modulators, FIG. 5(*b*), the corresponding A and B modulator stages charge and switch together.

The effectiveness of this type of coupling arrangement has been experimentally demonstrated on the Dos Lineas magnetic modulator pair located at Sandia National Laboratories. The technique was tested with ±1$\mu$s offsets in the triggers delivered to the primary SCR switches on the two machines, and it was tested with forced differences of 320 V out of 5 kV in the initial charge voltages supplied to the inputs of the two machines. For comparison to the PSPICE simulation of FIGS. 3A and 3B, this initial charge voltage difference corresponds to a 9 kV difference in the charge voltages on the magnetic switches. These tests yielded several important results.

Figure 6A:
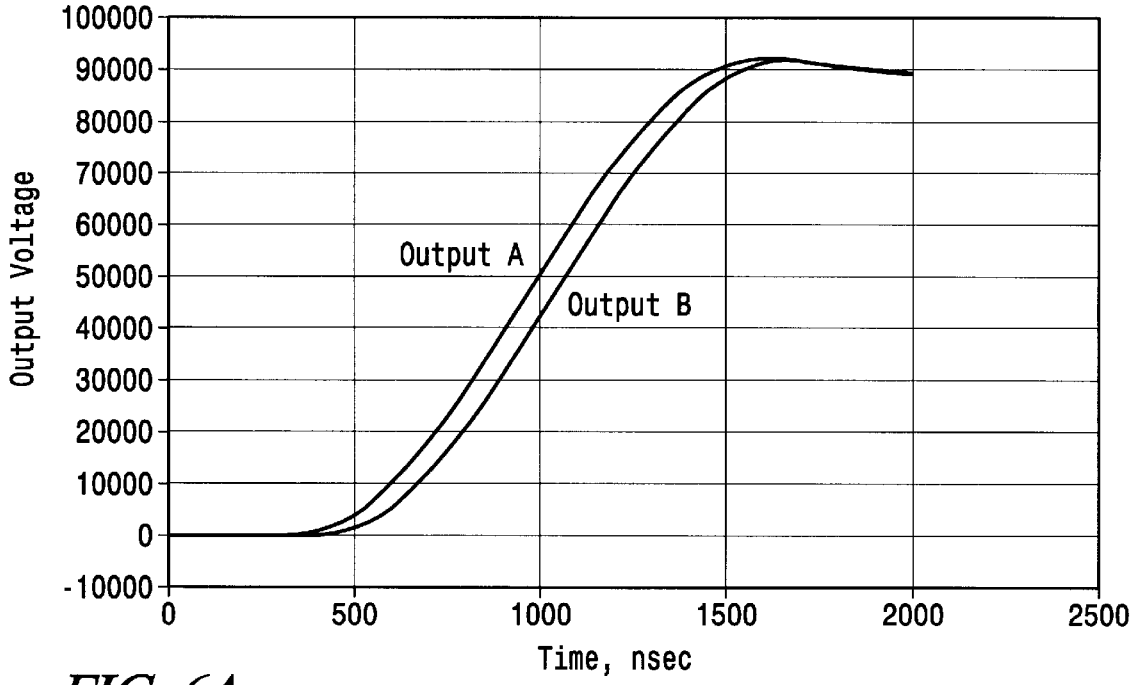
FIGS. 6A and 6B compare the timing between the measured output A and measured output B from a pair of laboratory magnetic modulators with the configuration of FIG. 2 when the magnetic switches are coupled.
Figure 6B:
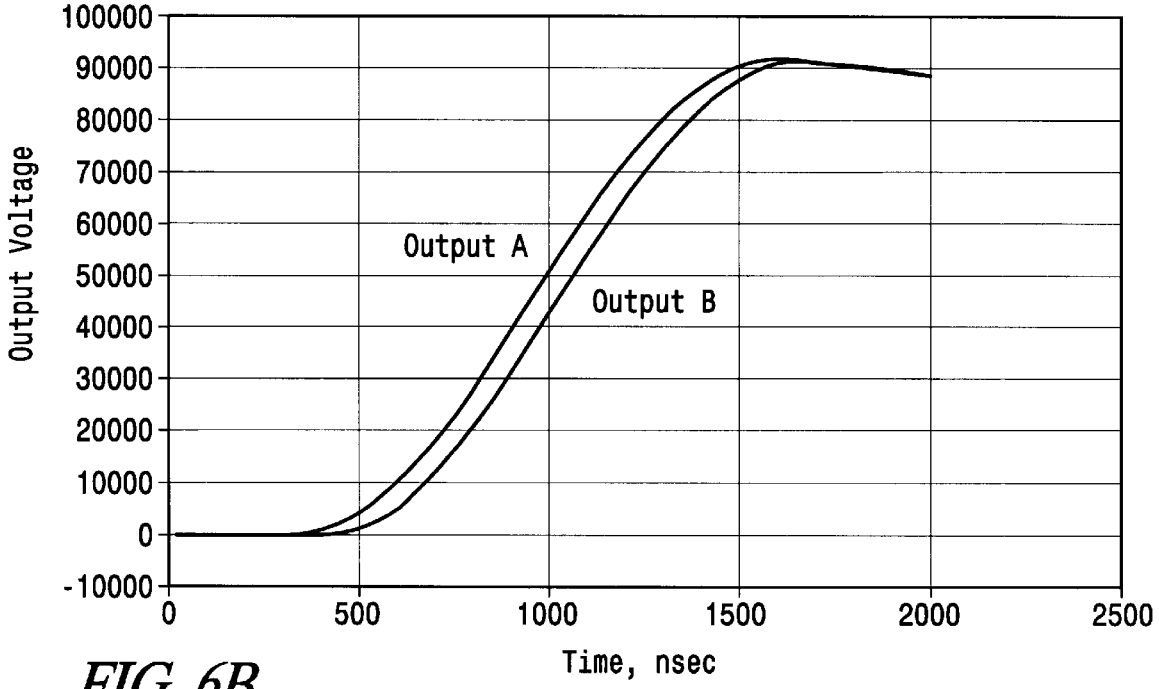

The peak voltages on the output voltages of the A and B machines were measured to be very nearly the same, as shown in FIG. 6*a*, demonstrating that the magnetic coupling pulled the amplitudes of the corresponding A and B capacitor charge voltages together, even in the presence of different initial charge voltages on the two machines. The measured results in FIG. 6*a* also. Furthermore, the fixed 70 ns offset that was measured between the outputs of the A and B modulators shows that the outputs are synchronized to within a fixed 70 ns timing difference both in the presence of a 320 volt difference in the input voltage to the modulators, FIG. 6(*a*), and in the presence of the prime switch SCR trigger timing offsets to the two machines, FIG. 6(*b*). The 70 ns offset between the two outputs is a constant for all shots and calculations indicate that it is caused by the constant propagation delay in the coupling windings.

Each magnetic switch has a coupling winding that consists of ten turns of wire equally distributed around the core on a mandrill outside the main electrical windings. Corresponding switches (MS1A corresponds to MS1B and MS2A corresponds to MS2B) are magnetically coupled by connecting the free ends of the coupling winding on one switch to the corresponding free ends of the coupling windings on the other switch, in this case, via a coaxial cable between the switches in such a way that no current will flow in the coupling windings if the currents in the main switch windings have the same input to output sense. The two coupling windings on corresponding switches and the intervening coaxial cable form a continuous electrical path that closes upon itself to form a continuous electrical loop. The coaxial cable is used to interconnect the coupling windings of corresponding switches in order to minimize the uncoupled series inductance in the coupling loop. Equal numbers of windings are utilized for coupling essentially identical magnetic switches. If the switches or the other components in the two coupled modulators are dissimilar in impedance, it may be necessary to use different numbers of coupling windings on the different switches to compensate for the impedance mismatch.

It has been experimentally demonstrated that magnetic coupling synchronized the switching times of corresponding magnetic switches in the two magnetically coupled modulators in the presence of forced trigger offsets, forced initial charge voltage offsets and intrinsic component differences.

Magnetic coupling synchronized the outputs of the two modulators in the presence of forced trigger offsets, forced initial charge voltage offsets and intrinsic component differences.

Figure 7:
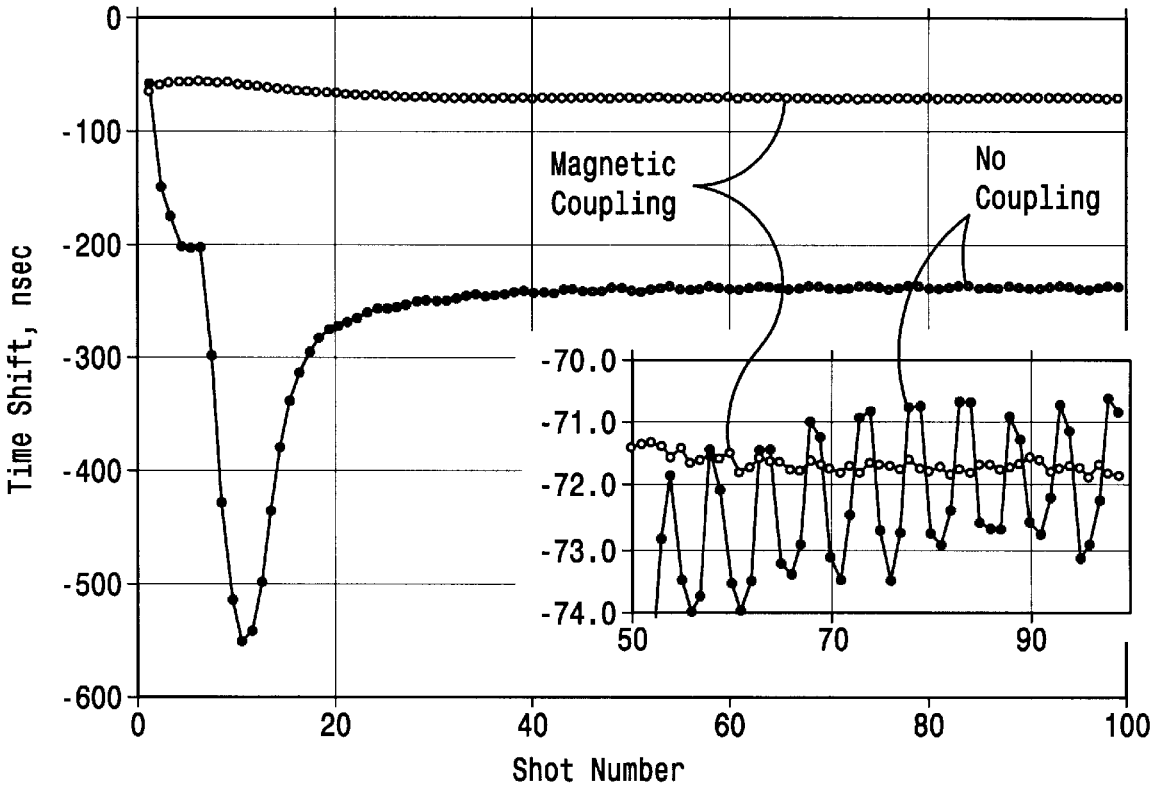
FIG. 7 is a graph showing the timing variation between the outputs of the A and B machines reduced by coupling and the jitter also being reduced.

Magnetic coupling reduced the random timing jitter between the outputs of the two modulators due to reflections 10 fold compared to the uncoupled value, as shown in FIG. 7.

Magnetic coupling yielded a more than 30 fold desensitization in the timing offsets at the outputs of the two magnetic modulators due to voltage variations on the CO capacitors at the start-up of the machines, FIG. 7. Even though the corresponding switches are switching simultaneously, the algorithm used to compare the A and B output pulses produces an apparent transient timing offset due to the change in the output inductance's caused by the voltage transient on the CO capacitors.

Figure 8:
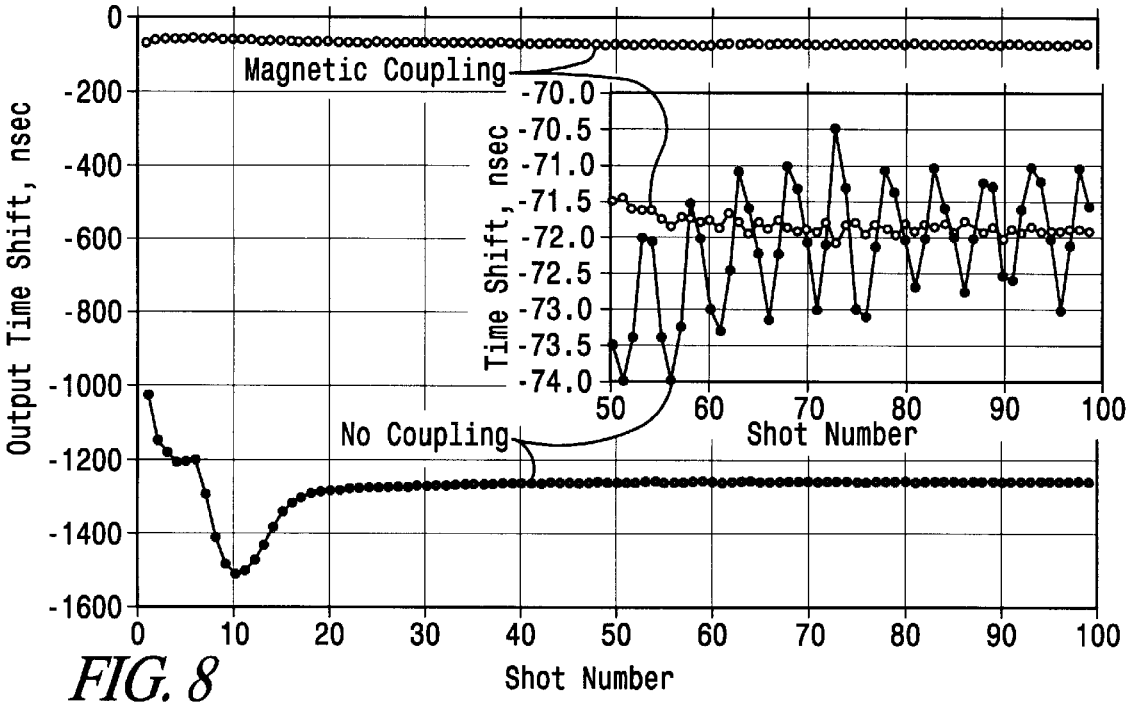
FIG. 8 is a graph showing the reduction in output time shift between modulators where A is triggered 1 $\mu$s before B.

Two further tests were conducted to demonstrate the effectiveness of the magnetic coupling. FIG. 8 shows the effect of a 1 $\mu$s time shift that was introduced in the triggers to the two machines. The shift is clearly visible without coupling but eliminated with coupling. The inset in this figure shows that magnetic coupling reduces steady-state time-shift ripple from 1 $\delta$=0.72 ns to 1 $\delta$=0.07 ns.

Figure 9:
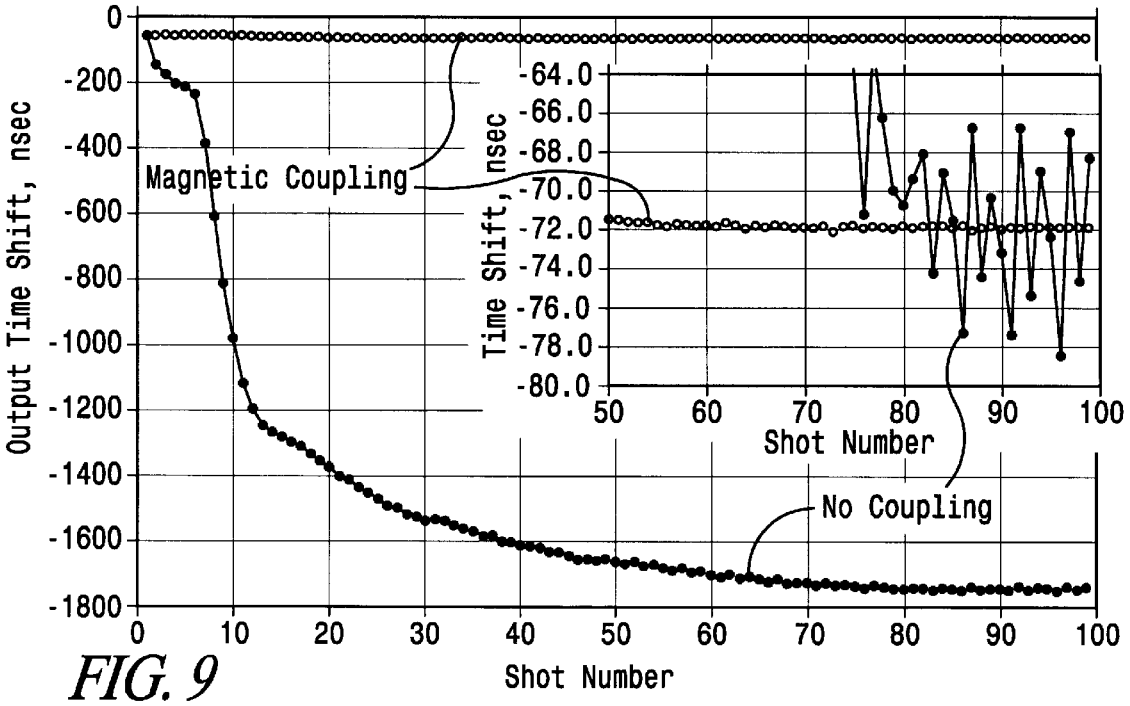
FIG. 9 is a graph showing the reduction in output time shift where A is charged 324 volts higher than B.

FIG. 9 shows similar reductions in time shift for a situation where modulator A was charged 324 volts higher than modulator B. The inset again shows the marked reduction in time-shift ripple.

A significant number of industrial applications for continuously operating pulse powered X-ray and electron beam generators require power levels approaching 1 MW. Food irradiation to eliminate pathogens, waste water treatment applications, and hazardous waste treatment require accelerating potentials in the 5 MV to 10 MV range to maximize efficiency and treatment depth as well as high power levels to provide high throughput. Linear induction voltage addition allows the output voltage to be increased by simply adding more stages; however, the power required for this increased voltage requires multiple, parallel pulse forming and modular networks. The Repetitive High Energy Pulsed Power (RHEPP) program at Sandia National Laboratories has produced a 2.5 MV accelerator with an average output power of 350 kW from a single magnetic compressor and pulse forming line. Using the RHEPP technology to produce a 5 MV accelerator would require 700 kW and 1.4 MW for a 10 MV accelerator. Impedance constraints coupled with physical size limitations, pulse risetime requirements, and component cooling requirements prohibit achieving these power levels from a single module. This technique solves the problem of synchronizing parallel, magnetically switched driver modules for application to high average power adders and accelerators.

What is claimed is:

1. An apparatus for synchronizing a pair of magnetic switches each of which is configured to discharge a respective first static energy storage device into a second respective static energy storage device by synchronizing the time of transition from a state of high inductance in each magnetic switch in the pair to a state of low inductance, comprising providing an electrically conductive loop connecting the cores of the pair of magnetic switches, the loop having windings about each of the cores.

2. The apparatus of claim 1 wherein at least one of the energy storage devices is a capacitor.

3. The apparatus of claim 1 wherein at least one of the energy storage devices is a transmission line.

4. The apparatus of claim 1 wherein the loop windings about each core of the magnetic switches, said cores also having a main winding about each, and said main windings are wound in the same direction.

5. The apparatus of claim 1 wherein the windings about each core are equal in number.

6. The apparatus of claim 1 wherein the windings about each core are unequal in number.

7. The apparatus of claim 1 wherein the loop includes a low inductance electrical connection for the portion of the loop between the two cores.

8. The apparatus of claim 7 wherein the low inductance electrical connection is a coaxial cable with a center conductor and a jacket conductor at one end of the coaxial being connected to each end of the loop winding about one of the cores and the center conductor and the jacket conductor of the other end of the coaxial cable being connected to each end of the loop winding about the other of the two cores.

* * * * *